US010518562B2

(12) United States Patent
Van Garsse et al.

(10) Patent No.: US 10,518,562 B2
(45) Date of Patent: Dec. 31, 2019

(54) INKJET PRINTING DEVICE FOR HEAVY-WEIGHT SUBSTRATES

(71) Applicant: AGFA NV, Mortsel (BE)

(72) Inventors: Joris Van Garsse, Mortsel (BE); Tom Cloots, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/769,759

(22) PCT Filed: Oct. 20, 2016

(86) PCT No.: PCT/EP2016/075191
§ 371 (c)(1),
(2) Date: Apr. 20, 2018

(87) PCT Pub. No.: WO2017/068026
PCT Pub. Date: Apr. 27, 2017

(65) Prior Publication Data

US 2018/0236790 A1 Aug. 23, 2018

(30) Foreign Application Priority Data

Oct. 23, 2015 (EP) ..... 15191190

(51) Int. Cl.

| | |
|---|---|
| ***B41J 11/06*** | (2006.01) |
| ***B41J 11/00*** | (2006.01) |
| ***B41J 2/01*** | (2006.01) |
| ***B41J 3/28*** | (2006.01) |

(52) U.S. Cl.
CPC ..... *B41J 11/06* (2013.01); *B41J 2/01* (2013.01); *B41J 3/28* (2013.01); *B41J 11/002* (2013.01); *B41J 11/0085* (2013.01)

(58) Field of Classification Search
CPC ..... B41J 11/06; B41J 3/28; B41J 3/025; B41J 2/01; B41J 11/0085
See application file for complete search history.

(56) References Cited

U.S. PATENT DOCUMENTS

| | | | | |
|---|---|---|---|---|
| 3,466,697 | A | 9/1969 | Cain et al. | |
| 3,739,894 | A | 6/1973 | Hinman | |
| 6,145,980 | A | 11/2000 | Wang | |
| 6,164,429 | A * | 12/2000 | Masciarelli, Jr. ..... | B65G 13/12 193/35 SS |

(Continued)

FOREIGN PATENT DOCUMENTS

| | | |
|---|---|---|
| EP | 1 191 242 A1 | 3/2002 |
| EP | 1 881 903 B1 | 11/2010 |

(Continued)

OTHER PUBLICATIONS

Official Communication issued in International Patent Application No. PCT/EP2016/075191, dated Nov. 18, 2016.

*Primary Examiner* — Kristal Feggins
*Assistant Examiner* — Kendrick X Liu
(74) *Attorney, Agent, or Firm* — Keating and Bennett, LLP

(57) ABSTRACT

An inkjet printing device includes a flatbed table for supporting on its support surface heavy-weight substrates to print on; and ball transfer units, arranged in the support surface, for transporting and/or positioning substrates on the flatbed table; wherein the inkjet printing device includes a drive module for moving away the ball transfer units from the support surface.

12 Claims, 5 Drawing Sheets

(56) References Cited

U.S. PATENT DOCUMENTS

| | | | | |
|---|---|---|---|---|
| 6,497,047 | B1 | 12/2002 | Miyagawa et al. | |
| 6,786,318 | B1 | 9/2004 | Pace et al. | |
| 7,007,787 | B2 | 3/2006 | Pallini et al. | |
| 8,577,496 | B1 | 11/2013 | Masters et al. | |
| 2002/0059888 | A1* | 5/2002 | Masciarelli ..... | B65G 13/12 108/49 |
| 2013/0008333 | A1 | 1/2013 | Peter et al. | |
| 2013/0307915 | A1* | 11/2013 | Persons ..... | B41J 11/007 347/104 |
| 2014/0120325 | A1 | 5/2014 | Brewington et al. | |

FOREIGN PATENT DOCUMENTS

| | | | |
|---|---|---|---|
| EP | 2 436 527 | A2 | 4/2012 |
| WO | 2004/002746 | A1 | 1/2004 |
| WO | 2011/101150 | A1 | 8/2011 |
| WO | 2013/153098 | A1 | 10/2013 |
| WO | 2013/177128 | A1 | 11/2013 |

* cited by examiner

INKJET PRINTING DEVICE FOR HEAVY-WEIGHT SUBSTRATES

CROSS REFERENCE TO RELATED APPLICATIONS

This application is a 371 National Stage Application of PCT/EP2016/075191, filed Oct. 20, 2016. This application claims the benefit of European Application No. 15191190.6, filed Oct. 23, 2015, which is incorporated by reference herein in its entirety.

BACKGROUND OF THE INVENTION

1. Field of the Invention

The present invention relates to an inkjet printing device, especially a flatbed table inkjet printing device, to load and position substrates, especially heavy-weight substrates, on the flatbed table.

2. Description of the Related Art

The availability of better performing print heads, such as less drop-outs and failing nozzles, and the lower cost of print heads, the maximum printing size of inkjet printing system is enlarged to print on large or multiple substrates such as wood, glass or printing plates. To support these large or multiple substrates, a large flatbed table has to be manufactured. A maximum use of the large flatbed table results in a higher amount of print jobs and better productivity which is economically beneficial.

Several inkjet printing device manufacturers sell moving gantry flatbed table inkjet printers wherein a substrate is loaded on a flatbed table and a gantry, comprising a set of print heads, is moved above the loaded substrate. The set of print heads scans back-and-forth above the substrate while printing. Examples of such moving gantry flatbed table inkjet printers are FUJIFILM™ Acuity Advance Select X2, Agfa Graphics™: Jeti Mira and SwissQPrint™ Nyala 2.

Another method used in flatbed table inkjet printing devices is moving the flatbed table with the loaded substrate underneath a set of print-heads, comprised on a gantry. The set of print heads scans back-and-forth while printing such as Agfa Graphics™: Jeti 3020 Titan.

The several existing methods of flatbed table inkjet printing devices have all their own advantages such as accuracy, high volume production, versatility.

But if the substrate is a rigid and heavy-weight substrate the state-of-the-art flatbed table inkjet printing device are not suitable to easily transport this kind of substrates and not suitable to easily position this kind of substrates on the flatbed table. Especially when an operator has to manually move such heavy-weight substrates for loading and positioning. Currently most countries are following ergonomics standards and relevant methods for risk assessment and management in WMSDs (Work-related Musculoskeletal Disorders) area such as: what is the largest weight that can be tilted and/or manipulated by an operator? A very high standard for this kind of risks is defined in the European Standard EN 1005-2 "Safety of machinery—Human physical performance—Part 2: Manual handling of machinery and component parts of machinery", April 2003. This European Standard specifies ergonomic recommendations for the design of machinery involving manual handling of machinery and component parts of machinery, including tools linked to the machine.

To satisfy such standards there is a need to manufacturing tools and add-on for the flatbed table inkjet printing devices.

WO2013177128 (GED INTEGRATED SOLUTIONS) discloses an inkjet printing device where a pallet is loaded in an auto-loading system on a plurality of fixed ball transfer units to transport the pallet easily underneath a print head for printing on the pallet.

For printing on glass sheet by an inkjet printing method, DURST™ presented the Durst RHO™ Vetrocer digital printing technology with modular table units of 2.2 m up to 8.8 m and the jetting of ceramic inks. The transport system comprises a plurality of fixed ball transfer units and a vacuum transport sled via magnetic drive to transport the glass sheets accurately underneath the print heads. To ease the transport of the glass sheets, the glass sheets are supported by the fixed ball transfer units and rolled-over the fixed ball transfer units.

Both disclosures comprising a support by a plurality of ball transfer units for heavy-weight substrates but high temperature; sometimes above 80 Celsius degrees; in an inkjet printing device, such as caused by a curing system to immobilize jetted ink layers on the substrate, dries the lubrication in the ball transfer units so efficacy is bad and replacements of these ball transfer units occur regularly.

In inkjet printing devices ink leakage, ink mist or ink splashes by errors caused by human actions are legion which pollute the ball transfer units of both disclosures. Also dust of the substrates causes contamination of the ball transfer units. Ink residue, whether or not cured, and/or dust impact the internal ball bearings in inkjet printing device, such as both disclosures, slows down the rotation, thus efficiency; of the ball transfer unit. This may result in an inhibitory effect and slowing down of the production of print-finished substrates.

There is also a need for inkjet printing devices which are capable of using several types of substrates to make productivity higher on the inkjet printing device. Both disclosures are not capably handling any type of substrate such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, plastic foils, transparency foils, adhesive PVC sheets, impregnated paper and others. For example a paper substrate may be supported by the plurality of ball transfer units but while printing the paper substrate is not hold flat which causes bad printing quality.

SUMMARY OF THE INVENTION

In order to overcome the problems described above, preferred embodiments of the present invention have been realised with an inkjet printing device and an inkjet printing method as defined below.

Further advantages and preferred embodiments of the present invention will become apparent from the following description.

BRIEF DESCRIPTION OF THE DRAWINGS

FIG. 3 illustrates a cross-cut of an inkjet printing device (300) from a preferred embodiment wherein a substrate (500) is loaded and supported on ball transfer units (450), as in A, which are attached to a sink system (400). The inkjet printing device (300) comprises a print head (305) and a drying system (315) for jetting an ink on the substrate (500). When printing on the substrate (500), as in B, the sink system (400) moves the ball transfer units (450) down so the substrate (500) is supported on the flatbed table (100) by connecting to the support surface (105) of the flatbed table (100). The printing of a liquid is performed by moving the print head (305) and drying system (315) back-and-forth above the flatbed table (100).

FIG. 4 illustrates a cross-cut of an inkjet printing device (300) from a preferred embodiment wherein a substrate (500) is loaded and supported on ball transfer units (450), as in A, which are attached to a sink system (400). The inkjet printing device (300) comprises a print head (305) and a drying system (315) for jetting an ink on the substrate (500). When printing on the substrate (500), as in B, the sink system (400) moves the flatbed table (100) up so the substrate (500) is supported on the flatbed table (100) by connecting to the support surface (105) of the flatbed table (100). The printing of a liquid is performed by moving the print head (305) and drying system (315) back-and-forth above the flatbed table (100).

DETAILED DESCRIPTION OF THE PREFERRED EMBODIMENTS

Figure 1:
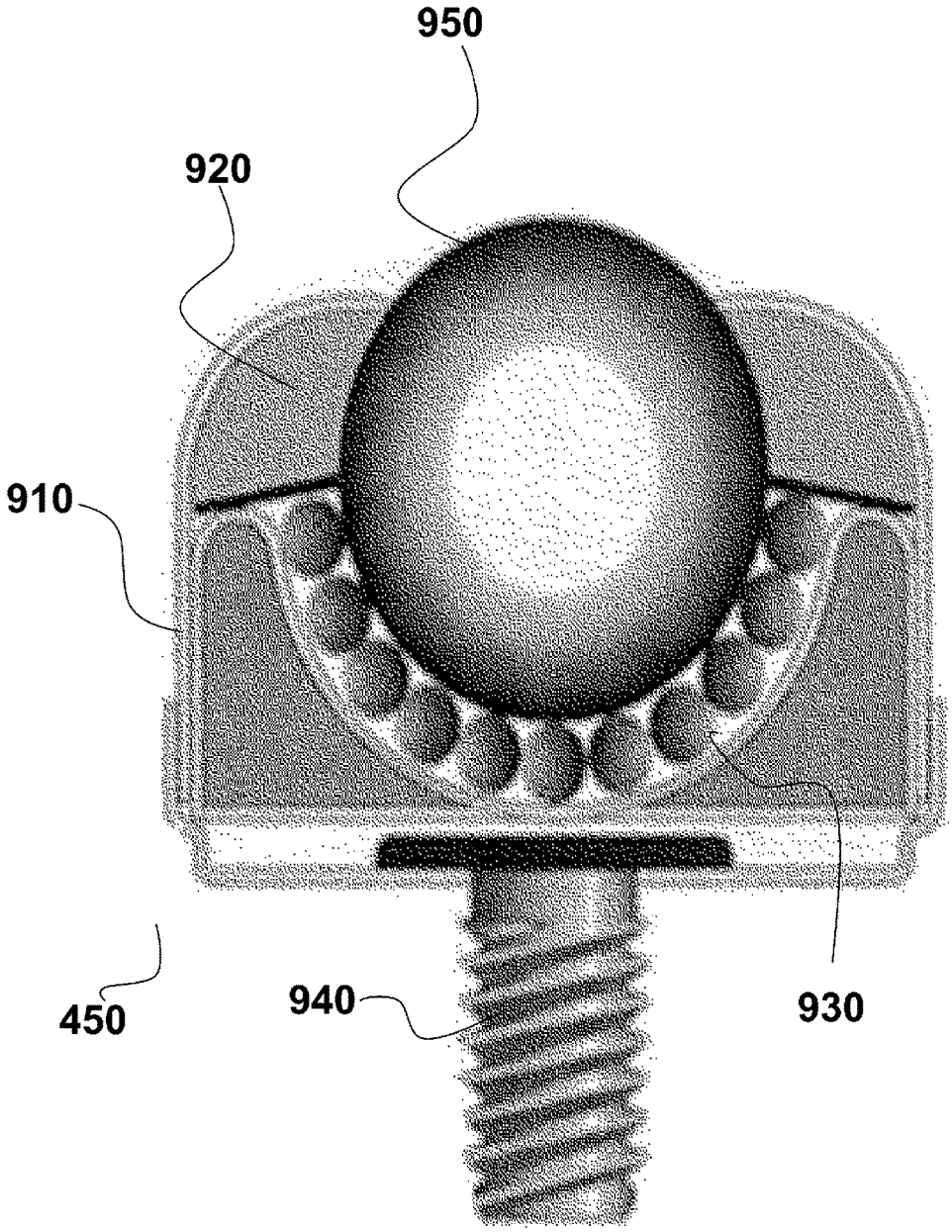
FIG. 1 illustrates a cross-cut of a ball transfer unit (450) comprising a load ball (950) attached to a plurality of smaller support balls (930) for rotating the load ball (950) smoothly. The illustrated ball transfer unit (450) comprises a felt seal to prevent that the housing (910) inside, such as the support balls (930), become dirty. The ball transfer unit (450) may be constructed on a ball transfer table (150) by a bolt (940). The ball transfer table (150) is not visible in the figure.

An embodiment of the present invention is an inkjet printing device (300) comprising: a flatbed table (100) for supporting on its support surface (105) substrates to print on; and ball transfer units (450), arranged in the support surface (105), for transporting and/or positioning substrates on the flatbed table (100); and wherein the inkjet printing device (300) comprises a drive module for moving away the ball transfer units (450) from the support surface (105).

The drive module may be handled manually but preferably it is powered by electric energy. The drive module may be driven by pneumatic or hydraulic cylinders, cams or levers for moving away the ball transfer units (450) from the support surface (105). The drive module may comprise differentials and/or locking differentials. In a preferred embodiment the drive module comprises one or more screw jacks, ball screw jacks, metric screw jacks, bevel gear jacks and/or bevel ball actuators. Such screw jack systems, suitable to be comprised in the drive module, are manufactured by ZIMM (www.zimm-screwjacks.com), such as their GSZ series.

The transporting and/or positioning of the substrates, supported by the ball transfer units (450), is above the flatbed table (100) and contactless with the support surface (105) of the flatbed table (100). When the substrate is loaded and positioned, the drive module moves the ball transfer units (450) away so the substrate is supported by the flatbed table (100) for printing on the substrate (500). The ease of transporting and/or positioning the substrates by the present invention, the inkjet printing device (300) makes it possible to follow the international and/or national laws against WMSDs.

The movement of the ball transfer units (450) away from the flatbed table (100), especially when the ball transfer units (450) are supporting a substrate, may be a controlled movement to control the acceleration of the movement so the ball transfer units (450) are smoothly moved away from the flatbed table (100). This smooth movement is an advantage to prevent damaging the substrate on top of the ball transfer units (450), especially when the substrate is fragile, breakable or brittle.

An embodiment of the present invention is also an inkjet printing method comprising the steps for printing on a substrate (500) by an inkjet printing device: transporting and/or positioning the substrate (500) on ball transfer units (450), arranged in the support surface of a flatbed table (100), which is comprised in the inkjet printing device (300), to support the substrate (500) while printing; and moving away the ball transfer units (450) from the support surface of the flatbed table (105) prior printing the substrate (500) and/or drying the inkjet printed substrate (500). The ball transfer units (450) are supporting the substrate while moving away the ball transfer units (450) from the support surface of the flatbed table (105).

Depending on the size of the substrate (150), it is possible that a set of the ball transfer units (450) does not support the substrate (150). In a preferred embodiment a set of the ball transfer units moves away from the support surface (105). In a more preferred embodiment each ball transfer unit in the ball transfer units (450) may move away independently from the support surface (105).

By moving away the ball transfer units (450) from the support surface (105) the ball transfer units have less chance to be contaminated by ink debris and dust from loaded substrates on the inkjet printing device (300). Also the aggressive atmosphere under the print head (305) may destruct the ball transfer units (450). Such aggressive atmosphere may comprise toxic and/or acid damps in the atmosphere.

Also by moving away the ball transfer units (450) scratches on the substrate, at the side where the ball transfer units are supporting the substrate, can be prevented because dried ink debris on the load balls of the ball transfer units (450) can give scratches to the substrate, such as glass.

The heating up of the ball transfer units (450) by the print head (305) or drying system (315) and/or contaminated ball transfer units (450) by ink debris on the load balls may contaminate the back side of the substrate (500) which is the side that is supported by the ball transfer units (450) and opposite to the print side of the substrate (500). The moving away of the ball transfer units (450) from the present invention prevents this contamination of the back-side which is a serious advantage so no after cleaning is needed.

The present invention has also the advantage that multiple kinds of substrate may be loaded, transported, unloaded and positioned on the inkjet printing device (300): Only on the flatbed table (100) or only on the ball transfer units (450). So flexible substrates are still possible to print on when positioned, transported, loaded and unloaded from the flatbed table (100). This multi-purposing ability in the present invention makes the embodiment an economical advantage because only one inkjet printing device (300) is needed.

In a preferred embodiment the drive module is a sink system (400) which moves the ball transfer units (450), perpendicular to the plane of the support surface (105), relative to the flatbed table (100), below the support surface (105); or which pivots the ball transfer units (450) towards the support surface and below the support surface of the flatbed table.

The inkjet printing method has a preferred method for moving away the ball transfer units (450) from the support surface (105) by comprising a step of pivoting the ball transfer units (450) towards the support surface (105) and below the support surface (105). The moving away is performed by a sink system (400). This is advantage is more important when printing on semi-transparent or transparent substrates such as glass sheet.

In a preferred embodiment the sink system comprises one or more screw jacks, ball screw jacks, metric screw jacks, bevel gear jacks and/or bevel ball actuators, so the sink system is able to support heavy-weight substrates and large substrates when supported on the ball transfer units (450). Such screw jack systems, suitable to be comprised in the sink module, may be manufactured by ZIMM (www.zimm-screwjacks.com).

The inkjet printing method has a preferred method for moving away the ball transfer units (450) from the support surface (105) by comprising a step a step of moving the ball transfer units (450), perpendicular to the plane of the support surface (105), relative to the flatbed table (100), below the support surface (105). The moving away is performed by a sink system (400).

The sink system may comprise pneumatic or hydraulic cylinders, cams or levers for moving or pivoting the ball transfer units (450). This preferred embodiment makes the manufacturing cost of such drive system low and can easily be manufactured with high precision.

The sink system (400) may move the ball transfer units (450) down and/or may move the flatbed table (100) up to relative move the ball transfer units (450) below the support surface (105).

To hold down the substrate (500) the flatbed table (100) may be a vacuum table wherein via air-channels in the flatbed table (100) and by vacuum power, provided by a vacuum chamber, the substrate (500) is hold down against the flatbed table (100). In a preferred embodiment a set of air-channels wrapping a ball transfer unit from the ball transfer units (450) when the ball transfer units (450) are below the support surface of the flatbed table. More preferable the sink system (400) is connected to the vacuum chamber to move or to pivot the ball transfer units (450) by vacuum power below the support surface (105).

It is important that the substrate (500) is held down fixed against the flatbed table (100) to prevent banding, color-on-color registration to avoid that the substrate (500) is repositioned while printing.

Figure 6:
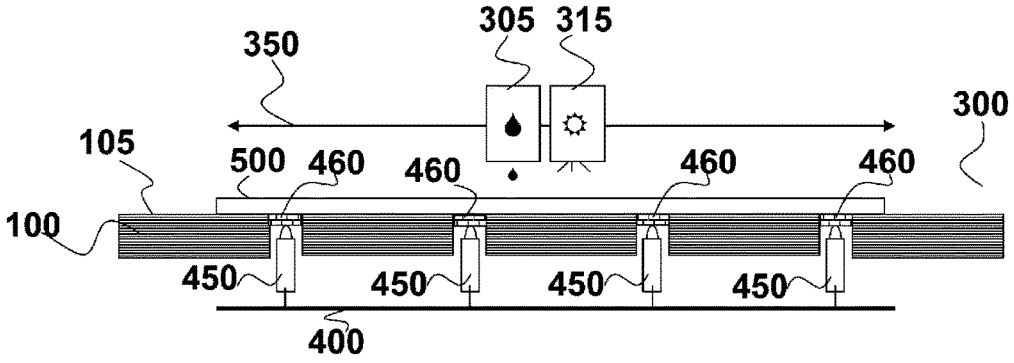
FIG. 6 is an inkjet printing device (300) as in FIG. 3 and FIG. 4 at the snapshot wherein the substrate (500) is supported by the flatbed table (100). The inkjet printing device (300) is a preferred embodiment by comprising a cap (460) above each ball transfer unit (450). The caps (460) are comprised in a cap system, which is not visible in the figure.

In the inkjet printing device (300) a drying system may be provided to immobilize, such as pin drying or final drying, the ink layer jetted on the substrate (500). A common way of drying a jetted ink layer is UV curing by an UV source or IR curing by an IR source. To prevent deformations of the ball transfer units or contamination of the ball transfer units; by ink leakages, ink splashes, ink mist, aggressive atmosphere underneath printhead (305); a preferred embodiment comprises a cap system for capping the ball transfer units (450) with a cap (460), preferably for each ball transfer unit a separate cap (see FIG. 6), towards the support surface (105) when the ball transfer units (450) are below the support surface (105). The cap system or each cap, comprised in the cap system, may comprise a light trap for trapping UV light from an UV source, comprised in the inkjet printing device (300) for preventing that UV light comes in the housing (910) of the ball transfer units (450). Such light trap is also called an UV light shielding. The cap system is also advantageous for preventing In a preferred embodiment the caps in the cap system are preferably radiation resistant from the radiation of the drying source, comprised in the inkjet printing device (300); more preferably UV radiation resistant from the radiation of the UV source, comprised in the inkjet printing device (300). In a preferred embodiment a cap in the cap system comprises an UV filter.

In a preferred embodiment the ball transfer units are moved underneath the support surface (105) until the ball transfer units are in the shadow of the flatbed table (100) wherein the shadow is caused by an UV source, comprised in the inkjet printing device In a preferred embodiment the inkjet printing device (300) comprises a gantry whereon a print head (305) is attached for printing on a substrate (500), loaded on the flatbed table (100); and wherein the inkjet printing device (300) comprises another drive module to move, parallel to the plane of the support surface (105), the flatbed table (100) linear and relative to the gantry underneath the print head (305) in a first direction to position the print head (305) above the substrate (500). More preferably the drive module moves the flatbed table (100) and/or moves the gantry to relative move underneath the print head (305) the flatbed table (100) to the gantry. To dry the jetted ink layer on a substrate a drying system, such as an UV source, may be attached to the gantry so the jetted ink layer is cured while the another drive module moves the flatbed table (100) linear and relative to the gantry underneath the print head (305). The moving away of the ball transfer units (450) is therefore advantageous because the radiation of the drying system may cause deformation of the ball transfer units (450) or drying out the lubrication inside the ball transfer units (450).

The previous preferred embodiment and its more preferred embodiment comprises a third drive module to move, parallel to the plane of the support surface (105) and perpendicular to the first direction, the print head (305) along the gantry for printing on the substrate (500). A drying system, such as an UV source, may be attached to the print head (305) so the jetted ink layer is cured while the third drive module move, parallel to the plane of the support surface (105*a* and perpendicular to the first direction, the print head (305) along the gantry for printing on the substrate (500). The moving away of the ball transfer units (450) is therefore advantageous because the radiation of the drying system may cause deformation of the ball transfer units (450) or drying out the lubrication inside the ball transfer units (450).

The substrate (500) to print-on by the inkjet printing device is preferably a heavy-weight substrate with a density (ρ) between 900 kg/m$^3$ and 20000 kg/m$^3$ and a surface between, 1 m$^2$ and 50 m$^2$.

The arrangement of the ball transfer units (450) in the flatbed table (100) depends on the size and kind of the substrates. The arrangement is typically a rectangular pattern in the state-of-the-art ball transfer tables. In a preferred embodiment the arrangement is a pseudo random pattern, more preferably a blue noise pseudo-randomly pattern.

In a preferred embodiment the inkjet printing method is an inkjet printing on glass sheet method or an inkjet printing on mirror sheet method.

In a preferred embodiment the inkjet printing device (300) is a glass inkjet printer, more preferably a multifunctional glass inkjet printer which is capable printing also on other substrates such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, plastic foils, transparency foils, adhesive PVC sheets, impregnated paper and others.

In a preferred embodiment the inkjet printing device (300) is a mirror inkjet printer, more preferably a multifunctional glass inkjet printer which is capable printing also on other substrates.

The handling of glass sheets or mirror sheets such as positioning of glass sheets is very delicate and fragile. The inkjet printing method and inkjet printing device of the preferred embodiment from this invention prevent the "rustying" of ball transfer units by ink debris or dust which could lead to fractures in the handled substrate. With "rustying" is meant the non-ductile behaviour of the load ball (950) or support balls (930) in a ball transfer unit (450) when contaminated or drying out of the lubrication inside the ball transfer unit (450).

Interior applications for inkjet printed glass sheets by the present inventions are preferably: shop furniture, bar decorations, fairs, glass for furniture, divider walls, videogames, shiny coatings, such as for coffee machines, elevators.

Outdoor applications for inkjet printed glass sheets by the present invention are preferably: buildings facades, temporary stores, seasonal outdoor signs or solar panels.

Figure 5:
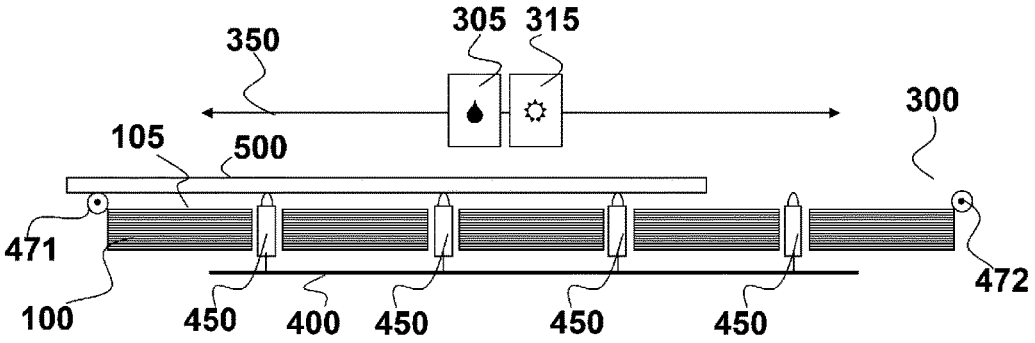
FIG. 5 is an inkjet printing device (300) as in FIG. 3 and FIG. 4 at the snapshot wherein the substrate (500) is supported by the ball transfer units (450). The inkjet printing device (300) is a preferred embodiment by comprising a roll (471) at the input of the flatbed table (100) and a roll at the output (472) of the flatbed table (100) for easy loading and unloading the substrate (450) from the ball transfer units (450).

At the input side of the flatbed table (100), which is the side where the substrates are loaded on the flatbed table (100) and/or at the output side of the flatbed table (100), which is the side where the substrates are unloaded from the flatbed table (100) a elongated roll may be attached for easy loading/unloading a substrate on/off the ball transfer units (450) by rolling over the elongated roll the substrate in/out the inkjet printing device (300) (See FIG. 5). The top of the roll is preferably positioned in the same plane wherein the top of the ball transfer units (450) are positioned. The top of a ball transfer unit (450) is the position whereon a substrate is supported. Also the roll may move away from the flatbed table (100) after loading/unloading the substrate on the ball transfer units (450).

Figure 7:
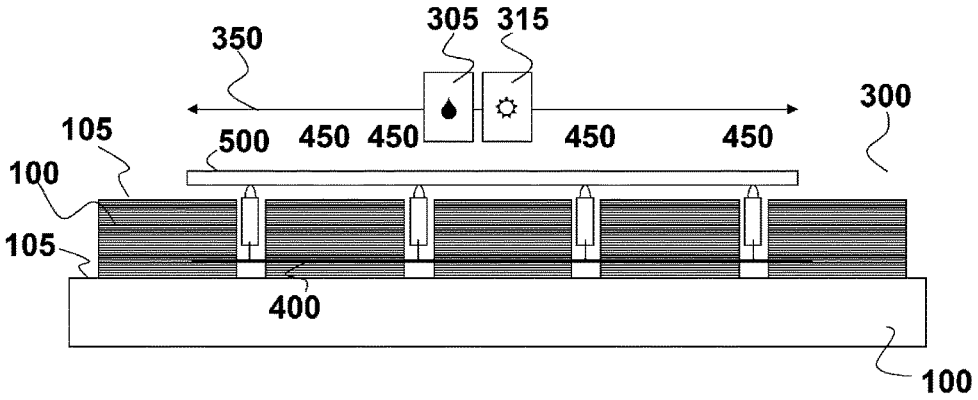
FIG. 7 is an inkjet printing device (300) from a preferred embodiment wherein a first flatbed table (100), is supported by a second flatbed table. The sink system (400) is comprised in the first flatbed table (100) wherein as in FIG. 3 at the snapshot wherein the substrate (500) is supported by the ball transfer units (450). The ball transfer units (450) sink in the first flatbed table (100) so the substrate (500) shall be supported by the first flatbed table (100).

In a preferred embodiment the flatbed table (100) of the present invention is supported on another flatbed table which is normally used for printing all kind of substrates but when printing heavy-weight substrates the flatbed table (100) is connected to the other flatbed table by manual or automated movement to bring the flatbed table (100) on top of the support surface of the other flatbed table (See FIG. 7). The other flatbed table may be a vacuum table and the connection with the flatbed table (100) is done by holding down the flatbed table (100) against the other flatbed table by its vacuum power on the support surface of the other flatbed table. The drive module to move away the ball transfer units (450) in this preferred embodiment is than attached to the flatbed table (100).

Ball Transfer Unit (450)

Figure 2:
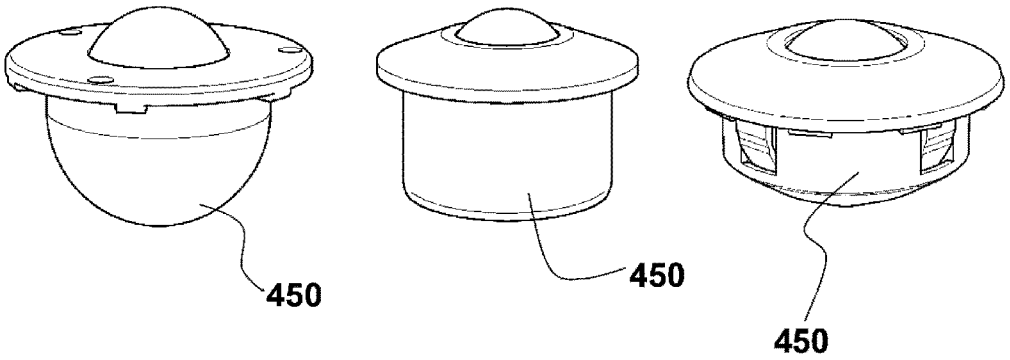
FIG. 2 illustrates several types of ball transfer units (450).
Figure 3:
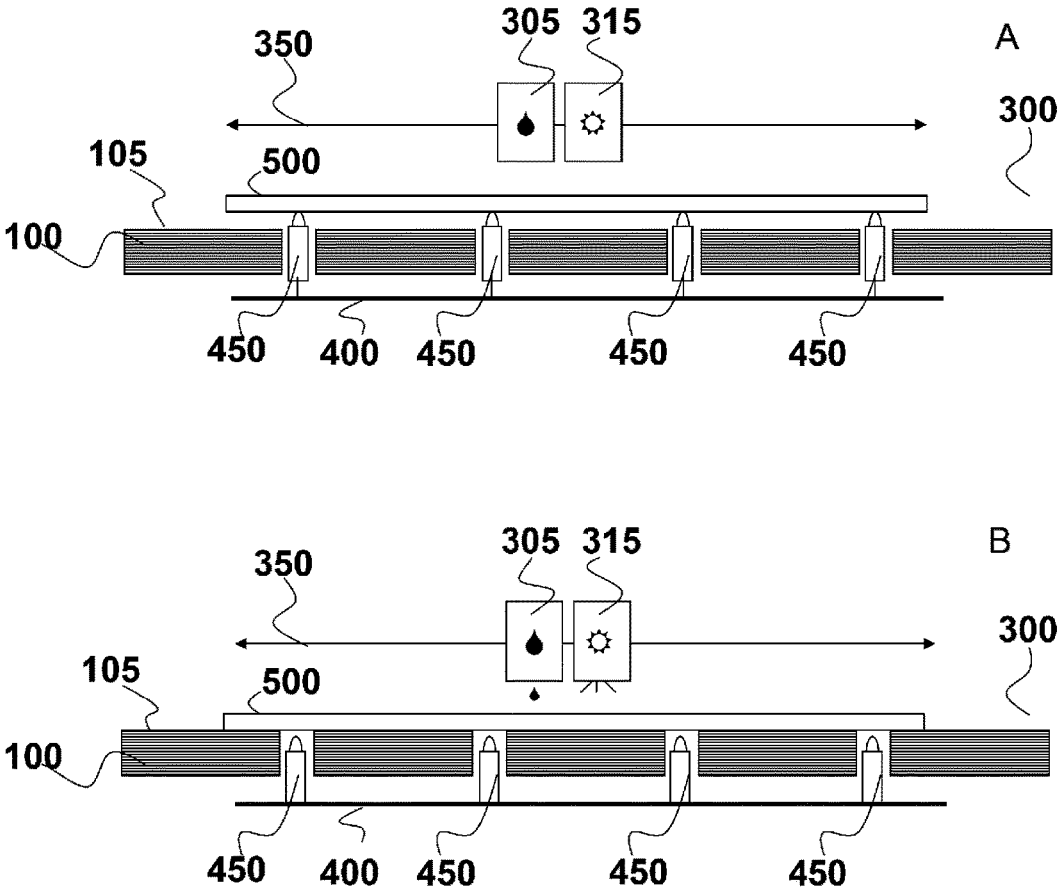
FIG. 3 illustrates in A and B snapshots for printing on a substrate (500), transported in an inkjet printing device (300), which is not visible in the figure.
Figure 4:
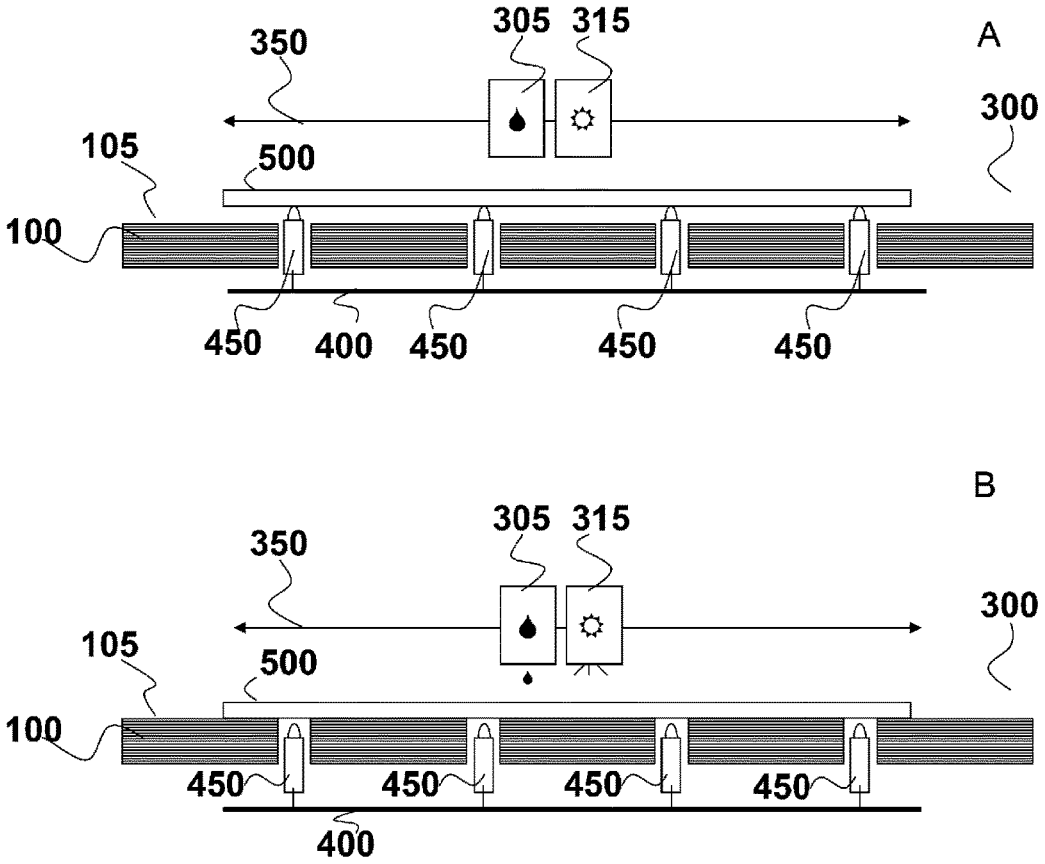
FIG. 4 illustrates in A and B snapshots for printing on a substrate (500), transported in an inkjet printing device (300), which is not visible in the figure.

A ball transfer unit is an omni-directional load-bearing spherical balls mounted inside a fixture, also called a housing (910) (See FIG. 1 and FIG. 2). A ball transfer unit (450) does not comprise any motor for moving the load ball, so the ball transfer unit (450) is an idle means. Also the ball transfer units are not restricted to one or two directional rotation. The fixture is mostly a restraining fixture. The design of a ball transfer unit is typically a single large ball, also called load ball (950), supported by smaller ball bearings, also called support balls (930). They are mainly used in airports for heavy-weight luggage delivery wherein the load ball (950) supports the luggage. A plurality of ball transfer units (450) are arranged to create a support plane for luggages. Such arrangement is also called a ball transfer table (150) wherein the luggage is pushed manually, through gravity, over the plurality of free rotating balls in the ball transfer units, fixed to a large frame or table. It is known that they are very effective where the luggage size is big and need to be pushed manually over long or short distance.

R.G.P INTERNATIONAL (www.rpgballs.com) and SKF USA (www.linearmotion.skf.com) are manufacturers of ball transfer units (450). They provide a whole range of designs for supporting heavy-weight materials on ball transfer units (450). They also provide solutions on the arrangement of ball transfer units (450) on a frame or table such as squared pitch or diamond pitch or extended pitch depending on the size of the heavy-weight materials that the ball transfer units (450) have to support.

More detailed information about the technical working of ball transfer units (450) are disclosed in U.S. Pat. No. 3,466,697 (BEARING SEALS & GEARS), U.S. Pat. No. 7,007,787 (ROLLER BEARING COMPANY OF AMERICA), EP1316518 (GOODRICH CORPORATION) and U.S. Pat. No. 3,739,894 (WESTERN GEAR CORP).

It is found that a ball transfer unit for the present invention preferably is:

a ball transfer unit (450) with washing fluid supplier with an ink cleaning liquid for suitable cleaning of ink debris from the load ball (950) and the support balls (930); and/or a ball transfer unit (450) with safeguard fluid supplier with an ink safeguard liquid for suitable safeguarding the rotation capacities of the ball transfer unit which are contaminated with ink debris; and/or ball transfer unit (450) with lubrication ports to incorporate, refilling, adding or replacing lubrications to the support balls (930) because incident drying radiation from the inkjet printing device (300) may dry the lubricator of the support balls (930); and/or a ball transfer unit (450) with a set of drain hole to drain ink debris from the ball transfer unit; and/or a ball transfer unit (450) with a seal ring, comprising a brush to prevent the contamination of the internal housing (910) and support balls (930) and/or to prevent drying radiation in the internal housing (910) and on the support balls (930). The drying radiation may cause non-ductile rotation of the load ball (950) and/or support balls (930) due to semi-dried or full-dried lubricator around the support balls (930). A seal ring in the state-of-the-art for ball transfer units is a felt seal and not a brush. An embodiment of the present invention is a ball transfer unit and not only in the field of inkjet printing devices but also generally for all kind of transporting devices comprising a seal for preventing dust coming in the ball transfer unit and wherein the seal is a brush. More preferred embodiments of this seal, attached to a ball transfer unit, comprising a brush are disclosed in the chapter "Other embodiment 1".

The load ball (950) of a ball transfer unit is preferably, more preferably also the fixture, is radiation resistant from a drying source to immobilize jetted layers on the substrate (500) in the inkjet printing device (300). The radiation resistant is in a preferred embodiment UV radiation resistant when the inkjet printing device (300) comprises an UV-source to immobilize jetted layers on the substrate (500).

The friction coefficient of the ball transfer unit (450), expressed as percent of the mass from the substrate, is preferably between 10% and 0.001% and more preferably between 5% and 0.01% and most preferably between 1% and 0.1%.

For high temperature resistance components of the ball transfer unit (450) are preferably made of steel and more preferably made of stainless steel and most preferably made of AISI 420C stainless steel.

For long life service of the ball transfer unit (450), the ball transfer unit (450) may be coated with corrosion treatment.

In a preferred embodiment the ball transfer units (450) has a conveying speed between 0.1 m/sec and 5 m/sec, more preferably between 1 m/sec and 3 m/sec for positioning and transporting the substrate (500) when supported by the ball transfer units (450). A high conveying speed is an advantage for fast transporting and/or positioning the substrate (500) on the inkjet printing device (300). The conveying speed is the maximum speed to transport and/or position manually a substrate (500), when supported by the ball transfer units (450) in the inkjet printing device (300).

The load ball (950) in a ball transfer unit (450) has preferably a diameter between 3 mm and 100 mm, more preferably between 8 mm and 70 mm and most preferably between 10 mm and 50 mm. The height of a ball transfer unit has to be chosen so the distance to may move away the ball transfer units (450) from the support surface (SSF) is minimal but in the mind that the diameter of the load ball (950) has to be optimal determined to support substrates based on weight of substrates and the friction between the load ball (950) and substrates.

The load ball (950) in a ball transfer unit (450) may comprise engineering thermoplastic such as Polyoxymethylene (POM), Phenolic Resin; AISI 420 stainless steel or AISI 440 stainless steel. The engineering thermoplastic prevents scratches on the back-side of the substrates (500), especially when the back-side is already printed, as in recto-verso printing.

Ball transfer units (450) on a ball transfer table (150) are typically arranged in regular and/or symmetrical way so they form a lattice pattern, which may have ball transfer unit rows and ball transfer unit columns. In a preferred embodiment this lattice pattern to arrange the ball transfer units is rhombic lattice, hexagonal lattice, parallelogram lattice, equilateral triangular lattice or a honeycomb lattice.

More preferably the ball transfer units are arranged in a randomly arranged pattern or pseudo-randomly arranged pattern and in a most preferred embodiment the ball transfer units are arranged in a blue noise pseudo-randomly arranged pattern. It is found that with this more preferred embodiment and most preferred embodiment that substrates are faster transported an surely faster positioned in the inkjet printing device (300).

A ball transfer unit (450) should be constructed to prevent damaging of a substrate. For example the edges of the housing (910) from the ball transfer unit (450) may have rounded edges. The ball transfer unit (450) and the edges of the housing (910) may be configured to have low frictional specifications.

The load ball (950) preferable comprises engineering plastics for scratch-free transporting and/or positioning of the substrate when supported on the ball transfer units (450). The engineering plastics comprises preferably for scratch-free handling highly durable polyimide, such as DuPont™ Vespel, or Polybenzimidazole, such as Duratron™ CU60 PBI, or Polyether ether ketone, also called PEEK.

Flatbed Table (100)

A flatbed table (100) is a support for a substrate (500) while an inkjet printing system is printing on the substrate (500). The support of substrates (500) has to be flat to print on large substrates (500). A flatbed table (100) comprises a base unit. The base unit is preferably stable and robust. It comprises fixing means suitable for attaching to an inkjet printing system. To have a strong, stable and robust base unit, the base unit comprises preferably metal such as steel or aluminium. The support layer may have any shape but is preferably rectangular shaped. The size of the support layer from the flatbed table (100) is preferably from 1 $m^2$ until 60.0 $m^2$, more preferably from 2.0 until 50.0 $m^2$ and most preferably from 3.00 until 30.0 $m^2$. The larger the size of the support layer, the larger a substrate (500) or more substrates (500) can be supported which results in a production boost. The width or height of the flatbed table (100) is preferably from 1.0 m until 10 m. The larger the width and/or height, the larger the substrate (500) may be supported by the flatbed table (100) which is an economical benefit.

Preferably the flatbed table (100) of the embodiment comprises a honeycomb structure plate which is sandwiched between a top and bottom sandwich plate. The top sandwich plate is preferably the top of the base unit. The weight of such flatbed table (100) and base unit is low because the weight of a honeycomb structure is lower than a solid flatbed table (100), especially when the support layer of the flatbed table (100) is at least 1.5 $m^2$. This results in easier manipulation and manufacturing of the flatbed table (100) or inkjet printing system wherein such a flatbed table (100) is constructed. A honeycomb structure plate results also in high stability and less bending of the flatbed table (100) (=better flatness). To achieve high stability the honeycomb structure plate comprises preferably metal such as aluminium. The width of the flatbed table (100) in the embodiment is equal to the dimension of the side of the printing table where the substrate (500) enters on the flatbed table (100). The length of the flatbed table (100) is equal to the dimension of the side perpendicular to the side of the flatbed table (100) where the substrate (500) enters on the flatbed table (100).

The flatness on the top of the support layer is crucial to have good print quality on a substrate (500) which is supported on the support layer because it influences the throw distance.

To measure the flatness of a flatbed table (100), several flatness measurement tools are available in the state-of-the art, for example the measurement tool disclosed in U.S. Pat. No. 6,497,047 (FUJIKOSHI KIKAI KOGYO KK).

The flatness of a flatbed table (100) can also be measured by surface profilometers such as the KLA-Tencor™ series of bench top stylus and optical surface profilometers.

The flatbed table (100) may comprise:

a heating device configured to heat a supported substrate (500) from its back-side; or a cooling device configured to cool a supported substrate (500) from its back-side; or a curing device configured to cure a jetted ink layer on a supported substrate (500) from its back-side; or a humidity regulator configured to humidify and/or dehumidify by a liquid a supported substrate (500) from its back-side. The back-side of a substrate (500) is the side which is in contact with the flatbed table. The opposite side of the back-side is the print-side.

Inkjet Printing Device (300)

An inkjet printing device (300), such as an inkjet printer, is a marking device that is using a print head (305) or a print head (305) assembly with one or more print heads (305), which jets a liquid, as droplets or vaporized liquid, on a substrate. A pattern that is marked by jetting of the inkjet printing device (300) on a substrate is preferably an image. The pattern may be achromatic or chromatic colour.

A preferred embodiment of the inkjet printing device (300) is that the inkjet printing device (300) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing.

A flatbed table (100) in the inkjet printing device (300) may move under a print head (305) or a gantry may move a print head (305) over the flatbed table (100). These so called flatbed table inkjet printers most often are used for the printing of planar substrates, ridged substrates and sheets of flexible substrates. They may incorporate drying system (315) such as IR-dryers or UV-dryers, to prevent prints from sticking to each other as they are produced. An example of a wide-format printer and more specific a flatbed table inkjet printer is disclosed in EP1881903 B (AGFA GRAPHICS NV).

Preferably the inkjet printing device (300) comprises one or more print heads (305) jetting UV curable ink to mark substrate and a UV source (=Ultra Violet source), as dryer source, to cure the inks after marking. Spreading of a UV curable inkjet ink on a substrate may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

Any ultraviolet light source, as long as part of the emitted light can be absorbed by the photoinitiator or photoinitiator system, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing. UV radiation is generally classed as UV-A, UV-B, and UV-C as follows:

UV-A: 400 nm to 320 nm

UV-B: 320 nm to 290 nm

UV-C: 290 nm to 100 nm.

In a preferred embodiment, the inkjet printing device (300) contains one or more UV LEDs with a wavelength larger than 360 nm, preferably one or more UV LEDs with a wavelength larger than 380 nm, and most preferably UV LEDs with a wavelength of about 395 nm.

Furthermore, it is possible to cure the image using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages e.g. a fast curing speed and a high curing degree.

For facilitating curing, the inkjet printing device (300) often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

The inkjet printing device (300) may comprise an IR source (=Infra Red source) to solidify the ink by infra-red radiation. The IR source is preferably a NIR source (=Near Infra Red source) such as a NIR lamp or a SWIR (=Short Wave Infra Red source) such as a SWIR lamp. The IR source may comprise carbon infrared emitters which has a very short response time.

The IR source or UV source in the above preferred embodiments create a drying zone on the flatbed table (100) to immobilize jetted ink on the substrate. Analogue as the drying zone, the inkjet printing device (300) comprises also a printing zone on the flatbed table (100) which defines the maximum print size of the inkjet printing device (300).

The inkjet printing device (300) may comprise corona discharge equipment to treating the substrate before the substrate passes a print head (305) of the inkjet printing device (300) because some substrates have chemically inert and/or nonporous top-surfaces leading to a low surface energy which may result in bad print quality.

The terms "partial dry", "pin dry", and "full dry" refer to the degree of drying, i.e, the percentage of converted functional groups, and may be determined by for example RT-FTIR (Real-Time Fourier Transform Infra-Red Spectroscopy) a method well known to the one skilled in the art of drying formulations. A partial dry, also called a pin dry, is defined as a degree of curing wherein at least 5%, preferably at least 10%, of the functional groups in the coated formulation is converted. A full dry is defined as a degree of drying wherein the increase in the percentage of converted functional groups, with increased exposure to radiation (time and/or dose), is negligible. A full dry corresponds with a conversion percentage that is within 10%, preferably within 5%, from the maximum conversion percentage defined by the horizontal asymptote in the RT-FTIR graph (percentage conversion versus curing energy or drying time).

The inkjet printing device (300) may contain a thermal curing device for removing water and organic solvents in the inkjet printed image. The thermal curing device may consist out of different units.

A pre-heating device may be included in the inkjet printing device (300) for heating the substrate prior to jetting. The pre-heating device may be an infrared radiation source as described here below, or may be a heat conduction device, such as a hot plate or a heat drum. A preferred heat drum is an induction heat drum.

The thermal curing device may include a dryer. Suitable dryers include devices circulating hot air, ovens, and devices using air suction. However for reducing energy consumption, preferably infrared radiation sources are used for thermal curing.

Preferred infrared radiation sources include near infrared radiation sources (NIR: 750-1400 nm) and short wave infrared radiation sources (SWIR: 1400-3000 nm). An advantage is that glass lenses, which may be included in the curing device for focusing the infrared light on the substrate, transmit in this infrared region, contrary to mid-wavelength infrared light (MWIR: 3000-8000 nm) or long-wavelength infrared light (LWIR: 8000-15000 nm).

The most preferred infrared light source is a SWIR light source because the water absorption significantly increases at 1450 nm.

A commercial example of a SWIR light source is a carbon infrared emitter CIR™ available from HERAEUS, for example emitting at a wavelength of about 2000 nm.

Another preferred thermal curing device is a NIR source emitting near infrared radiation. NIR-radiation energy quickly enters into the depth of the inkjet ink layer and removes water and solvents out of the whole layer thickness, while conventional infrared and thermo-air energy predominantly is absorbed at the surface and slowly conducted into the ink layer, which results usually in a slower removal of water and solvents.

Commercially available NIR emitters are available from ADPHOS™.

The thermal curing device may be, preferably at least in part, arranged in combination with the print head of the inkjet printer, travelling therewith so that the curing radiation is applied very shortly after jetting. This allows pinning the aqueous UV free radical curable inkjet ink when jetted on the substrate.

Substrates

The inkjet printing device (300) may mark a broad range of substrates (500) such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, glass sheet, wood, flexographic plates, metal based plates, fibreglass, plastic foils, transparency foils, adhesive PVC sheets, mirror sheets, impregnated paper and others. A substrate may comprise an inkjet acceptance layer. A substrate may be a paper substrate or an impregnated paper substrate or a thermosetting resin impregnated paper substrate.

In a preferred embodiment the substrate (500) is a large substrate with a dimension between 1 $m^2$ and 50 $m^2$, more preferably between 2 $m^2$ and 25 $m^2$. The thickness of the large substrate is preferably between 1 mm and 30 mm, more preferably between 3 mm and 25 mm.

In a preferred embodiment the substrate (500) is a heavy-weight substrate with a density between 750 $kg/m^3$ and 20000 $kg/m^3$, and more preferably a large substrate with a dimension between 1 $m^2$ and 50 $m^2$, more preferably between 2 $m^2$ and 25 $m^2$. The density of a heavy-weight substrate is more preferably between 1250 $kg/m^3$ and 10000 $kg/m^3$, and most preferably between 2000 $kg/m^3$ and 5000 $kg/m^3$.

In a preferred embodiment the substrate (500) is a flat substrate which means that the to-be-printed surface approximate a mathematical plane.

In a preferred embodiment the substrate (500) is a wood panel and the inkjet printing device (300) is a wood inkjet printer. Such a printer is disclosed in WO2011101150 (DIEFFENBACHER). A wood panel is preferable a door, furniture panel, parquet panel or floor laminate.

In another preferred embodiment the substrate (500) is plasterboard and the inkjet printing device (300) is a plasterboard inkjet printer. Such a printer is disclosed in EP2836373 (KNAUF GIPS)

The substrate is preferable a concrete-plate and the inkjet printing device (300) is preferable a concrete-plate inkjet printer. Such a printer is disclosed in US20140120325 (XEROX)

The substrate is preferable a glass sheet and the inkjet printing device (300) is preferable a glass sheet inkjet printer, also called glass inkjet printer. Such a printer is disclosed in EP2436527 (TECGLASS). Other glass inkjet printers are manufactured by DIPTech (www.dip-tech.com): "Dip-Tech Digital In-Glass Printers".

The substrate is preferable a metal sheet and the inkjet printing device (300) is preferable a metal sheet inkjet printer, also called metal inkjet printer.

The preferred embodiments in the present invention makes it easier to transport and/or position wood panels, plasterboard, concrete-plate, glass sheet, metal sheet with their fragility, breakability, frailty and/or heavy-weight on/from the inkjet printing device (300).

In a preferred embodiment the inkjet printing device (300) may comprise an attached loading station, loading station, drying station, infeed station, a horizontal washer and/or outfeed station.

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed substrates (200), but also to primed substrates (200).

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, substrate fibers, ink, ink residues and/or ink debris such as cured ink, to contaminate via the set of air-channels (605) of the flatbed table (100) the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Inkjet Vacuum Table

To avoid registration problems while printing on a substrate and to avoid collisions while conveying a substrate, the substrate needs to be connected to a flatbed table (100). An inkjet vacuum table is a flatbed table wherein the substrate is connected to the flatbed table (100) by vacuum pressure. An inkjet vacuum table is also called a porous flatbed table or in short wordings also called vacuum table.

Preferably the inkjet vacuum table in the embodiment comprises a set of air-channels to provide a pressure differential by a vacuum chamber at the support layer of the inkjet vacuum table to create a vacuum zone and at the bottom-surface of the flatbed table (100) a set of apertures which are connected to the set of air-channels. These apertures at the bottom layer may be circular, elliptical, square, rectangular shaped and/or grooves, such as slits, parallel with the bottom layer of the inkjet vacuum table.

The width or height of the inkjet vacuum table is preferably from 1.0 m until 10 m. The larger the width and/or height, the larger the substrate may be supported by the inkjet vacuum table which is an economical benefit.

A set of apertures at the support layer of the inkjet vacuum table may be connected to the air-channels. These apertures at the support layer may be circular, elliptical, square, rectangular shaped and/or grooves, such as slits, parallel with the support layer of the inkjet vacuum table. Preferably, if the apertures are grooves, the grooves are oriented along the printing direction of the inkjet printing device (300).

Preferably the inkjet vacuum table of the embodiment comprising a honeycomb structure plate which is sandwiched between a top and bottom sandwich plate which comprises each a set of apertures connect to one or more air-channels in the inkjet vacuum table. The honeycomb cores, as part of the air-channels, in the honeycomb structure plate results in a better uniform vacuum distribution on the support surface of the inkjet vacuum table.

The dimensions and the amount of air-channels should be sized and frequently positioned to provide sufficient vacuum pressure to the inkjet vacuum table. Also the dimensions and the amount of apertures at the bottom-surface of the inkjet vacuum table should be sized and frequently positioned to provide sufficient vacuum pressure to the inkjet vacuum table. The dimension between two air-channels or two apertures at the bottom-surface of the inkjet vacuum table may be different. A honeycomb core is preferably sinusoidal or hexagonal shaped.

If a honeycomb structure plate is comprised in the inkjet vacuum table also the dimensions and the amount of honeycomb cores should be sized and frequently positioned to provide sufficient vacuum pressure to the inkjet vacuum table. The dimensions between two neighbour honeycomb cores may be different.

The support layer of the flatbed table (100) should be constructed to prevent damaging of a substrate. For example the apertures at the support layer that are connected with the air-channels may have rounded edges. The support layer of the flatbed table (100) may be configured to have low frictional specifications.

The inkjet vacuum table is preferably parallel to the ground whereon the inkjet printing system is connected to avoid misaligned printed patterns.

The top-surface of the inkjet vacuum table or a portion of the inkjet vacuum table, such as the inner side of its air-channels may be coated to have easy cleaning performances e.g. as result of dust or ink leaks. The coating is preferably a dust repellent and/or ink repellent and/or hydrophobic coating. Such coating may also be applied on the ball transfer units (450). Preferably the top-surface of the inkjet vacuum table or a portion of the inkjet vacuum table, such as the inner side of its air-channels, is treated with an ink repelling hydrophobic method by creating a lubricious and repelling surface which reduces friction.

In a preferred embodiment the inkjet vacuum table comprises a plurality of vacuum zones and more preferably variable sized vacuum zones.

A vacuum zone may in a preferred embodiment change independently its vacuum power to hold down a substrate (500) even-more or ease the de-coupling of the substrate (500) from a gantry.

Each vacuum zone may in a preferred embodiment change in a positive pressure, such as air blowing, to decouple print-finished substrate from the inkjet vacuum table.

Each vacuum zone may in a preferred embodiment change in a positive pressure, such as air blowing, to create an air cushion to ease the loading of a substrate (500) on the inkjet vacuum table and/or unloading the substrate (500) from the inkjet vacuum table.

In a preferred embodiment the inkjet vacuum table comprises a plurality of air cushion zones and more preferably variable sized air cushion zones.

An air cushion zone may in a preferred embodiment change independently its air cushion power to ease the loading of a substrate (500) on the inkjet vacuum table and/or unloading the substrate (500) from the inkjet vacuum table.

Print Head (305)

A print head (305) is a means for jetting a liquid on a substrate through a nozzle. The nozzle may be comprised in a nozzle plate which is attached to the print head (305). A print head (305) preferably has a plurality of nozzles which may be comprised in a nozzle plate. A set of liquid channels, comprised in the print head (305), corresponds to a nozzle of the print head (305) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a print head (305) is also called a jettable liquid.

The way to incorporate print heads (305) into an inkjet printing device (300) is well-known to the skilled person.

A print head (305) may be any type of print head (305) such as a Valvejet print head, Piezoelectric print head, thermal print head (305), a continuous print head (305) type, electrostatic drop on demand print head (305) type or acoustic drop on demand print head (305) type or a page-wide print head (305) array, also called a page-wide inkjet array.

A print head (305) comprises a set of master inlets to provide the print head (305) with a liquid from a set of external liquid feeding units. Preferably the print head (305) comprises a set of master outlets to perform a recirculation of the liquid through the print head (305). The recirculation may be done before the droplet forming means but it is more preferred that the recirculation is done in the print head (305) itself, so called through-flow print heads (305). The continuous flow of the liquid in a through-flow print heads (305) removes air bubbles and agglomerated particles from the liquid channels of the print head (305), thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow print head (305) is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the print head (305) wherein the mixing means is attached to the set of master inlets and the set of liquid channels. The mixing means may comprise a stirring device in a liquid container, such as a manifold in the print head (305), wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the print head (305). The droplet forming means are activating the liquid channels to move the liquid out the print head (305) through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The print head (305) of the present invention is preferably suitable for jetting a liquid having a jetting viscosity of 8 mPa·s to 3000 mPa·s. A preferred print head (305) is suitable for jetting a liquid having a jetting viscosity of 20 mPa·s to 200 mPa·s; and more preferably suitable for jetting a liquid having a jetting viscosity of 50 mPa·s to 150 mPa·s.

Valvejet Print Head

A preferred print head (305) for the present invention is a so-called Valvejet print head. Preferred valvejet print heads (305) have a nozzle diameter between 45 and 600 μm. The valvejet print heads (305) comprising a plurality of micro valves, allow for a resolution of 15 to 150 dpi that is preferred for having high productivity while not comprising image quality. A valvejet print head is also called coil package of micro valves or a dispensing module of micro valves. The way to incorporate valvejet print heads (305) into an inkjet printing device (300) is well-known to the skilled person. For example, US 2012105522 (MATTHEWS RESOURCES INC) discloses a valvejet printer including a solenoid coil and a plunger rod having a magnetically susceptible shank. Suitable commercial Valvejet print heads (305) are chromoJET™ 200, 400 and 800 from Zimmer, Printos™ P16 from VideoJet and the coil packages of micro valve SMLD 300's from Fritz Gyger™. A nozzle plate of a Valvejet print head is often called a faceplate and is preferably made from stainless steel.

The droplet forming means of a valvejet print head controls each micro valve in the valvejet print head by actuating electromagnetically to close or to open the micro valve so that the medium flows through the liquid channel. Valvejet print heads (305) preferably have a maximum dispensing frequency up to 3000 Hz.

In a preferred embodiment the valvejet print head the minimum drop size of one single droplet, also called minimal dispensing volume, is from 1 nL (=nanoliter) to 500 μL (=microliter), in a more preferred embodiment the minimum drop size is from 10 nL to 50 μL, in a most preferred embodiment the minimum drop size is from 10 nL to 300 μL. By using multiple single droplets, higher drop sizes may be achieved.

In a preferred embodiment the valvejet print head has a native print resolution from 10 DPI to 300 DPI, in a more preferred embodiment the valvejet print head has a native print resolution from 20 DPI to 200 DPI and in a most preferred embodiment the valvejet print head has a native print resolution from 50 DPI to 200 DPI.

In a preferred embodiment with the valvejet print head the jetting viscosity is from 8 mPa·s to 3000 mPa·s more preferably from 25 mPa·s to 1000 mPa·s and most preferably from 30 mPa·s to 500 mPa·s.

In a preferred embodiment with the valvejet print head the jetting temperature is from 10° C. to 100° C. more preferably from 20° C. to 60° C. and most preferably from 25° C. to 50° C.

Piezoelectric Print Heads

Another preferred print head (305) for the present invention is a piezoelectric print head. Piezoelectric print head, also called piezoelectric inkjet print head (305), is based on the movement of a piezoelectric ceramic transducer, comprised in the print head (305), when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric print head controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial piezoelectric print heads are TOSHIBA TEC™ CK1 and CK1L from TOSHIBA TEC™ (https://www.toshibatec.co.jp/en/products/industrial/inkjet/products/cf1/) and XAAR™ 1002 from XAAR™ (http://www.xaar.com/en/products/xaar-1002).

A liquid channel in a piezoelectric print head is also called a pressure chamber.

Between a liquid channel and a master inlet of the piezoelectric print heads, there is a manifold connected to store the liquid to supply to the set of liquid channels.

The Piezoelectric print head is preferably a through-flow piezoelectric print head. In a preferred embodiment the recirculation of the liquid in a through-flow piezoelectric print head flows between a set of liquid channels and the inlet of the nozzle wherein the set of liquid channels corresponds to the nozzle.

In a preferred embodiment in a Piezoelectric print head the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes.

In a preferred embodiment the Piezoelectric print head has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the Piezoelectric print head has a native print resolution from 25 DPI to 2400 DPI, in a more preferred embodiment the Piezoelectric print head has a native print resolution from 50 DPI to 2400 DPI and in a most preferred embodiment the Piezoelectric print head has a native print resolution from 150 DPI to 3600 DPI.

In a preferred embodiment with the Piezoelectric print head the jetting viscosity is from 8 mPa·s to 200 mPa·s more preferably from 25 mPa·s to 100 mPa·s and most preferably from 30 mPa·s to 70 mPa·s.

In a preferred embodiment with the Piezoelectric print head the jetting temperature is from 10° C. to 100° C. more preferably from 20° C. to 60° C. and most preferably from 30° C. to 50° C.

The nozzle spacing distance of the nozzle row in a piezoelectric print head is preferably from 10 μm to 200 μm; more preferably from 10 μm to 85 μm; and most preferably from 10 μm to 45 μm.

Inkjet Ink

In a preferred embodiment, the liquid in the print head (305) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

In a preferred embodiment the inkjet ink is an inorganic pigment ink specially developed for glass printing, specifically float glass and laminated safety glass (LSG). The inkjet ink preferably comprises a mixture of metallic; non-toxic pigments, lead-free glass frits and dispersing and carrier fluids. The inkjet ink is suitable for directly printing on glass without the need of priming the glass. This preferred and more preferred inkjet ink, when fired in an external oven above 400 degrees Celsius, the ink mellts together with the glass permanently.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

An inkjet ink may comprise functionality features such as anti-slip, electrically conductivity, anti-bacterial.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s−1 or with the HAAKE Rotovisco 1 Rheometer with sensor C60/1 Ti at a shear rate of 1000 s−1

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the print head (305) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

Other Embodiment 1

An embodiment of the present invention is a ball transfer unit comprising a seal which comprises a brush. In the state-of-the-art a seal in a ball transfer unit is mostly a felt seal. The seal is to exclude debris on the bearings, also called the support balls (930) and/or to exclude drying inside the ball transfer units so dried up lubrication in the ball transfer units is prevented or dried up of liquids which contaminates the ball transfer units is prevented.

The brush preferably touches the outside surface of the load ball (950), comprised in the ball transfer unit.

The brush may be a carpet fabric wherein the carpet fabric may have a pile composed of yarn tufts in loop and/or cut configuration and/or wherein the height of pile is from 0.5 mm to 20 mm and/or wherein the fabric density of the carpet fabric is from 1000 until 100000 filaments per $cm^2$ and/or wherein the pile is composed of polytetrafluoroethylene (PTFE), polypropylene (PP), polyurethane, polyester, aromatic polyamides (ARAMID), rayon, acrylic, cellulose, viscose or nylon.

A brush is a tool with a plurality of hairs, also called bristles, wire or filaments. The brush is used for cleaning a surface and radiation prevention. The brush in the embodiment of the ball transfer unit (450) is attached to the housing (910). Contamination and radiation passing the brush may be captured and may be held by the plurality of hairs.

The minimum distance between the housing (910), without the brush, and the outer surface of the loading ball may be from 0.001 mm to 5.00 mm, preferably from 0.01 mm to 1.00 mm.

The brush comprised in the housing (910) may be rotatable around an axis to get a better prevention of contamination in the ball transfer unit (450).

The filaments of the brush in the embodiment of the ball transfer unit (450) preferably may comprise a fluoropolymer or a fluorocarbon based polymer with multiple strong carbon-fluorine bond, because the characterization of a high resistance to solvents, acids, and bases.

In a preferred embodiment of the ball transfer unit (450) the brush is a carpet fabric.

Another advantage of the carpet fabric is the higher freedom of having more inaccurate dimensions of the ball transfer unit, and its housing (910). This higher design freedom makes the construction of the porous printing table cheaper.

Preferably the carpet fabric, as brush, in the embodiment of the ball transfer unit (450) is attached and more preferably wrapped around the innerside of the housing (910).

A pile of a carpet fabric is the visible surface of the carpet fabric, after attaching the primary back to a means, consisting of yarn tufts in loop and/or cut configuration. A pile of a carpet fabric is also called the face or the nap of the carpet fabric.

The carpet-backing fabric of a carpet fabric is a means into which the yarn tufts are inserted. The primary back may be made of jute, kraftcord, cotton, woven or non-woven synthetics; preferably the carpet-backing fabric of the carpet fabric in the embodiment comprises polypropylene.

Pile height is the length (expressed in decimal parts of one inch) of the yarn tuft from the carpet-backing fabric to the top surface of the carpet fabric. A carpet fabric with a higher pile height will possess more yarn on the carpet-backing fabric and will essentially be more durable. The pile height of the carpet fabric in a preferred embodiment is from 0.0001 to 3 mm and preferably from 0.001 mm to 1 mm.

The carpet fabric density of the carpet fabric may be from 500 $cm^2$ until 100000 filaments per $cm^2$; preferably be from 2000 $cm^2$ until 110000 filaments per $cm^2$ The pile of the carpet fabric as brush in the embodiment of the ball transfer unit (450) may be composed of polytetrafluoroethylene (PTFE), polypropylene (PP), polyurethane, polyester, aromatic polyamides (ARAMID), rayon, acrylic, cellulose, viscose or nylon, preferably composed of polytetrafluoroethylene (PTFE).

Preferably the loosing of filaments in the carpet fabric as brush in the embodiment of the ball transfer unit (450) must be minimized by:

ultrasonic cutting of the edges of the carpet fabric; and/or
removing the loose filaments during or after cutting.

The distance between the carpet fabric and the outside surface of the load ball (950) may be smaller than the height of the pile.

Other characterization of the carpet fabric as brush in the embodiment of the ball transfer unit may be:

antimicrobial carpet fabric; and/or
antistatic carpet fabric; and/or
dimensional stable carpet fabric.

Other Embodiment 2

Figure 8:
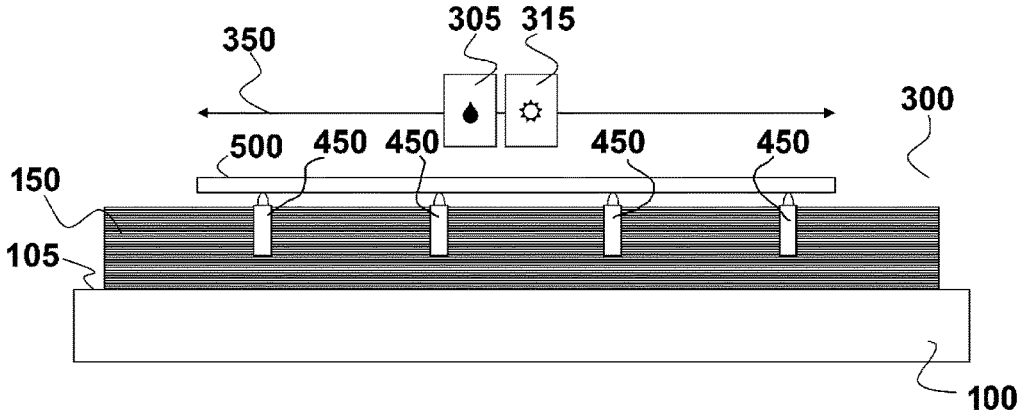
FIG. 8 is an inkjet printing device (300) from a preferred embodiment wherein a ball transfer table (150) is supported by a flatbed table (100). The ball transfer table (150) is detachable from the flatbed table (100) for printing flexible substrates on the flatbed table (100). The ball transfer table (150) is coupled to the flatbed table (100) for printing heavy-weight substrates.
Figure 9:
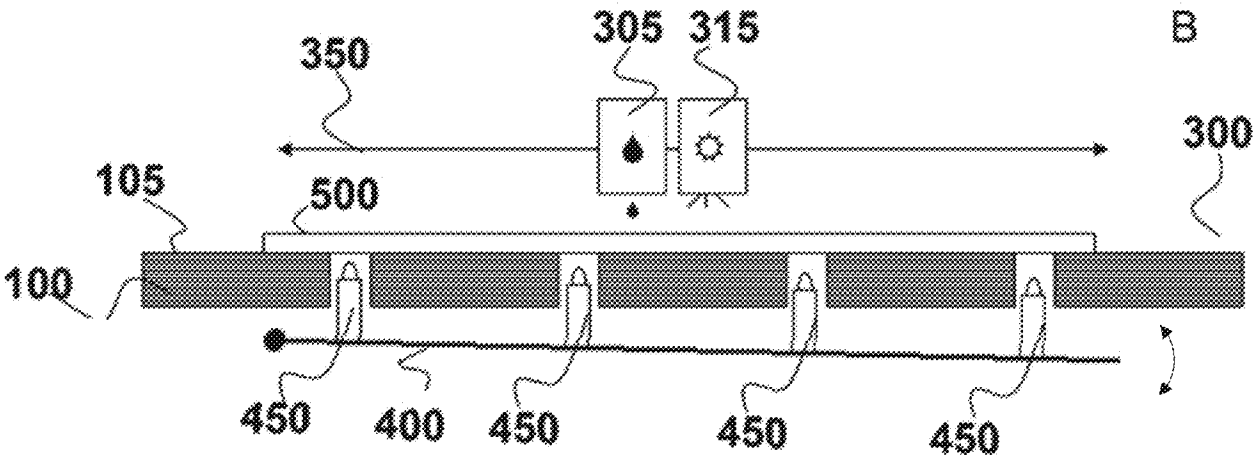
FIG. 9 shows a sink system (400) which pivots the ball transfer units (450) towards the support surface and below the support surface of the flatbed table (100).

An embodiment of the present invention is an inkjet printing device (300) wherein a ball transfer table (150) is supported on a flatbed table (100) which is normally used for printing all kind of substrates but when printing heavy-weight substrates the ball transfer table (150) is connected to the flatbed table (100) by manual or automated movement to bring the ball transfer table (150) on top of the support surface of the flatbed table (100). (See FIG. 8)

This embodiment has also the advantage that multiple kind of substrates may be loaded, transported, unloaded and positioned on the inkjet printing device (300): Only on the flatbed table (100) or only on the ball transfer units (450) of the ball transfer table (150). So flexible substrates are still possible to print on when positioned, transported, loaded and unloaded from the flatbed table (100). This multi-purposing ability in this embodiment makes the embodiment an economical advantage because only one inkjet printing device (300) is needed.

The flatbed table (100) may be a vacuum table and preferably the connection with the ball transfer table (150) is done by holding down the ball transfer table (150) against the flatbed table by its vacuum power on the support surface of the flatbed table (100).

Other connection systems may also be used such as screws or any kind of click system.

In the inkjet printing device (300) a drying system may be provided to immobilize, such as pin drying or final drying, the ink layer jetted on the substrate (500). Common way of drying a jetted ink layer is UV curing by an UV source or IR curing by an IR source.

In a preferred embodiment the inkjet printing device (300) comprises a gantry whereon a print head (305) is attached for printing on a substrate (500), loaded on the flatbed table (100) or the connected ball transfer table (150); and wherein the inkjet printing device (300) comprises another drive module to move, parallel to the plane of the support surface (105), the flatbed table (100) linear and relative to the gantry underneath the print head (305) in a first direction to position the print head (305) above the substrate (500). More preferably the drive module moves the flatbed table (100) and/or moves the gantry to relative move underneath the print head (305) the flatbed table (100) or connected ball transfer table (150) to the gantry.

The previous preferred embodiment and its more preferred embodiment comprises a third drive module to move, parallel to the plane of the support surface (105) and perpendicular to the first direction, the print head (305) along the gantry for printing on the substrate (500).

The substrate (500) to print-on by the inkjet printing device is preferably a heavy-weight substrate, supported on the ball transfer table (150) with a density ($\rho$) between 900 $kg/m^3$ and 20000 $kg/m^3$ and a surface between, 1 $m^2$ and 50 $m^2$.

The arrangement of the ball transfer table (450) depends on the size and kind of the substrates. The arrangement is typically a rectangular pattern in the state-of-the-art ball transfer tables (150). In a preferred embodiment the arrangement is a pseudo random pattern.

REFERENCE SIGNS LIST

TABLE 1

| | | | |
|---|---|---|---|
| 450 | Ball transfer unit | 315 | Drying system |
| 950 | Load ball | 500 | Substrate |
| 930 | Support balls | 100 | Flatbed table |
| 940 | Bolt | 400 | Sink system |
| 920 | Felt seal | 300 | Inkjet printing device |
| 910 | Housing | 105 | Support surface |
| 350 | Print head movement | 471 | Roll |
| 150 | Ball transfer table | 460 | Cap |
| 305 | Print head | 472 | Roll |

The invention claimed is:

1. An inkjet printing device comprising:

a flatbed table including a support surface to support a substrate to be printed on;

a plurality of ball transports provided in the support surface to transport and/or to position the substrate on the flatbed table; and a first drive that moves the plurality of ball transports away from the support surface of the flatbed table; wherein the first drive includes a sink system that pivots the plurality of ball transports towards the support surface and to below the support surface of the flatbed table.

2. The inkjet printing device according to claim 1, wherein the flatbed table is a vacuum table including a vacuum chamber and a plurality of air-channels that hold the substrate against the flatbed table by vacuum; and a set of the plurality of air-channels surrounds a ball transfer unit of the plurality of ball transports when the plurality of ball transports are below the support surface of the flatbed table.

3. The inkjet printing device according to claim 2, wherein the sink system is connected to the vacuum chamber to move or to pivot the plurality of ball transports by vacuum to below the support surface.

4. The inkjet printing device according to claim 1, further comprising:

caps that cap the plurality of ball transports towards the support surface when the plurality of ball transports are below the support surface of the flatbed table.

5. The inkjet printing device according to claim 1, wherein the substrate supported on the support surface of the flatbed table is rigid and planar and has a density between 500 kg/m$^3$ and 20,000 kg/m$^3$ and a surface area between 1 m$^2$ and 50 m$^2$.

6. An inkjet printing method for printing on a substrate with an inkjet printing device, the method comprising the steps of:

transporting and/or positioning the substrate on a plurality of ball transports provided in a support surface of a flatbed table;

inkjet printing on the substrate and/or drying the inkjet printed substrate; and moving the plurality of ball transports away from the support surface of the flatbed table prior to printing on the substrate and/or prior to drying the inkjet printed substrate; wherein the step of moving the plurality of ball transports away from the support surface includes pivoting the plurality of ball transports towards the support surface and to below the support surface.

7. The inkjet printing method according to claim 6, further comprising, prior to inkjet printing on the substrate and/or drying the inkjet printed substrate, a step of:

capping the plurality of ball transports towards a top surface of the flatbed table.

8. The inkjet printing method according to claim 6, wherein the substrate has a density between 500 kg/m$^3$ and 20,000 kg/m$^3$ and a surface area between 1 m$^2$ and 50 m$^2$.

9. An inkjet printing device comprising:

a flatbed table including a support surface to support a substrate to be printed on;

a plurality of ball transports provided in the support surface to transport and/or to position the substrate on the flatbed table; and a first drive that moves the plurality of ball transports away from the support surface of the flatbed table; wherein the first drive includes a sink system that moves the plurality of ball transports perpendicular to a plane of the support surface, relative to the flatbed table, and to below the support surface of the flatbed table;

the flatbed table is a vacuum table including a vacuum chamber and a plurality of air-channels that hold the substrate against the flatbed table by vacuum; and a set of the plurality of air-channels surrounds a ball transfer unit of the plurality of ball transports when the plurality of ball transports are below the support surface of the flatbed table.

10. The inkjet printing device according claim 9, wherein the sink system moves the flatbed table upward to relatively move the plurality of ball transports to below the support surface of the flatbed table.

11. The inkjet printing device according to claim 9, further comprising:

caps that cap the plurality of ball transports towards the support surface when the plurality of ball transports are below the support surface of the flatbed table.

12. The inkjet printing device according to claim 9, wherein the substrate supported on the support surface of the flatbed table is rigid and planar and has a density between 500 kg/m$^3$ and 20,000 kg/m$^3$ and a surface area between 1 m$^2$ and 50 m$^2$.

* * * * *